United States Patent [19]

Wilzig et al.

[11] 4,315,647

[45] Feb. 16, 1982

[54] BOLT MECHANISM AND METHOD OF MAKING SAME

[76] Inventors: Herbert Wilzig, 606 N. 5th St., Montebello, Calif. 90640; Charles J. Schuessler, 1340 E. Ruddock, Covina, Calif. 91722

[21] Appl. No.: 76,737

[22] Filed: Sep. 18, 1979

[51] Int. Cl.[3] ..... E05C 1//06

[52] U.S. Cl. ..... 292/143; 292/DIG. 21

[58] Field of Search ..... 292/141, 143, 145, 40, 292/DIG. 21

[56] References Cited

U.S. PATENT DOCUMENTS

| | | | |
|---|---|---|---|
| 52,570 | 2/1866 | Havell | 292/145 |
| 1,162,945 | 12/1915 | Ohnstrand | 292/143 X |
| 1,378,622 | 5/1921 | Sarbij | 292/142 |
| 1,670,430 | 5/1928 | Alexander | 292/143 |
| 2,035,033 | 3/1936 | Wakefield | 292/145 |
| 2,251,038 | 7/1941 | Danen | 292/145 |
| 2,819,107 | 1/1958 | Muessel | 292/143 |
| 3,103,114 | 9/1963 | Atkinson | 292/145 X |
| 3,556,573 | 1/1971 | Miller | 292/143 |
| 4,098,101 | 7/1978 | Svoboda | 292/143 X |

*Primary Examiner*—Richard E. Moore

*Attorney, Agent, or Firm*—Poms, Smith, Lande & Rose

[57] ABSTRACT

A flush bolt is disclosed which is adapted for flush mounting on a door. The flush bolt is composed of a latch sled and faceplate. Both the latch sled and faceplate may be constructed by stamping sheet metal. The latch sled is slidably mounted on the faceplate by way of integral longitudinal channels which engage tracks which are an integral part of the faceplate. Both tracks and channels are formed during the stamping process. An actuator arm slidably operates the latch sled between engaged and disengaged positions. A biasing spring is provided for biasing the actuator arm to either the engaged or disengaged position. A forked tongue having a slot for guiding the biasing spring extends upwardly from the latch sled and is also formed during the stamping process. The slot which is formed during the stamping of the forked tongue is notched to provide securing of the housing spring. The tracks on the faceplate and housing on the latch sled are formed from material displaced from openings formed to receive the actuator arm.

18 Claims, 7 Drawing Figures

BOLT MECHANISM AND METHOD OF MAKING SAME

BACKGROUND OF THE INVENTION

In general, the present invention relates to door latches. More specifically, the invention relates to those type of latches which are mounted flush within the edge of a door and are manually operable to extend a latching bolt outwardly from the edge of the door into a securing surface such as a door frame, floor or the like. This type of latch is commonly referred to as a flush bolt.

Flush bolts have found use particularly in double door systems where it is desirable to allow movement of one door while securing the other door in a closed or open position. The flush mounting design is desired because it allows mounting of the latch on the outer edge of each door so that the latch does not protrude from the edge of each door, thereby avoiding the need for a large gap between the two doors.

The prior art flush bolts have been composed of a faceplate and a latch sled which are both formed by casting. The face plate is cast having channels for slidably receiving tracks located on the latch sled which are also formed during casting. Both the channels and tracks are machined after the casting process to insure proper engagement. The process of casting and machining these items provides for a flush bolt which functions normally, however, it would be desirable to produce a flush bolt which is composed of parts produced by stamping of sheet metal.

The versatility of the stamping process would allow formation of tracks or channels on either the faceplate or the latch sled without the need for subsequent machining. Additionally, stamping of sheet metal provides for the economical production of the flush bolts. Stamping the parts for the flush bolt obviates the expensive operations involved in casting, such as the machining of the part to required specifications after the product has been cast. The stamping provided by this invention allows full utilization of the sheet metal. For example, when slots or holes are stamped in the sheet metal, the material from the slots or holes may be formed into useful structures on the faceplate or latch sled.

SUMMARY OF THE INVENTION

It is therefore an object of the present invention to disclose and provide a flush bolt which is produced by stamping.

Another object of the present invention is to disclosed and provide a flush bolt having novel structural features for slidably mounting a latch sled on a faceplate.

A further object of the present invention is to disclose and provide a flush bolt having novel structural features for mounting and guiding the flush bolt biasing means.

A further object of the present invention is to disclose and provide a flush bolt adapted for flush mounting which can be constructed of relatively lightweight sheet metal materials.

Generally stated, the present invention comprises a faceplate which is adapted to be disposed in a door edge to provide an outer surface flush with the door edge. Means are provided for mounting the faceplate on the door. A latch sled is provided which is moveable between an engaged position for securing the door to a securing surface and a disengaged position.

Means are provided for slidably mounting the latch sled on the faceplate.

Means are also provided for slidably moving the latch sled between engaged and disengaged positions.

Finally, means are provided for biasing the moving means to the engaged or disengaged position.

A more complete understanding of the flush bolt of the present invention, as well as a recognition of additional objects and advantages therefor will be afforded to those skilled in the art from a consideration of the following detailed description of an exemplary embodiment thereof. Reference will be made to the appended drawings which will first be discussed briefly.

DETAILED DESCRIPTION OF THE PREFERRED EXEMPLARY EMBODIMENT

Figure 1:
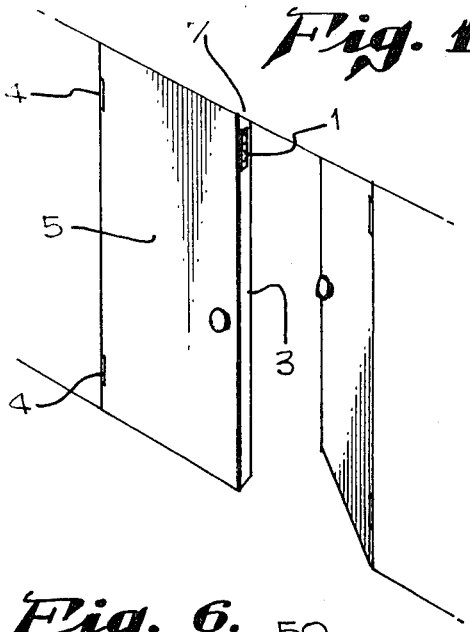
FIG. 1 is a general perspective view showing the flush bolt of the present invention in its preferred mounting position on the edge of a door.

First referring to FIG. 1, the preferred exemplary embodiment of the flush bolt of the present invention is shown at 1 where it is mounted to a door 5 on the door edge 3. The door 5 is rotably secured to a wall by hinges 4. The flush bolt 1 is operable to an engaged position with the door frame 7 and a disengaged position where it is retracted into the door 5. In the engaged position, the flush bolt 1 is secured to the door frame 7 thereby preventing movement of the door. When the flush bolt 1 is in the disengaged position, it is not secured to the door frame 7 thereby allowing movement of the door.

Reference will now be made to FIGS. 2 through 7. The preferred embodiment of the flush bolt of the present invention has a faceplate 10 which may be formed by stamping flat sheet metal stock such as brass, aluminum, bronze or stainless steel wherein the sheet metal thickness may vary between 0.04 inches and 0.10 inches. Although a particular structure for a face plate is shown in the preferred embodiment, it should be noted that faceplates for flush bolts can vary widely in structure and that faceplate 10 is only one possible variation of the large number of possible faceplate configurations which could be used within the concepts of the present invention.

Means for mounting the faceplate 10 to the door 5 are provided by the formation of four mounting holes 14 located in each of the four corners of the faceplate 10. During the formation of the mounting holes 14, screw head contact surfaces 12 are formed which provide for the securing of the faceplate 10 to the door 5 by mounting screws 6 wherein the screw heads contact the screw head contact surfaces 12 so that the top of the screws become flush with the exterior surface 11 of the faceplate 10 as the screws are tightened. Also during the stamping process, upper access well 16 and lower access well 18 for allowing manual access to the actuator arm 30 are formed in the faceplate 10. Additionally, during the stamping process, a slot 24 is stamped out of the center of the faceplate 10, with the material from the slot being formed into tracks 20 and 22. The tracks 20 and 22 are a part of the means for mounting the latch sled 50 to the faceplate 10 and will be described in detail later. The stamping process for forming the tracks 20 and 22 prevents the waste of sheet metal. By using the metal which is removed to form slot 24 to form tracks 20 and 22, this process accomplishes two objectives with one operation. The objectives being the formation of the slot 24 and the formation of the tracks 20 and 22.

The latch sled 50 of the preferred embodiment of the present invention may also be formed by stamping sheet metal, such as brass, aluminum, bronze, or stainless steel which may vary in thickness from 0.04 inches to 0.10 inches. Again, as with the faceplate 10, the latch sled 50 of the preferred embodiment of the present invention is only one particular structure available from a wide number of possible structures utilized in producing latch sleds for use in flush bolts. During stamping, a bolt mounting flange 74 is integrally formed perpendicular to the body of the latch sled 50. The bolt mounting flange 74 is provided with a threaded annular protrusion 76 which is formed by stamping a hole in the bolt mounting flange 74 and threading the resulting annular protrusion 76 for receiving a threaded stud 102, which in the preferred embodiment of the present invention is an integral part of the bolt 100.

Means for slidably mounting the latch sled 50 on the faceplate 10 are provided by the tracks 20 and 22 on the faceplate 10 and the channels 52 and 56 on the latch sled 50. The channels 52 and 56 are formed during the stamping process and are an integral part of the latch sled 50. Prior art flush bolts have the channels on the faceplate and the tracks on the latch sled. The present invention is not restricted in this way. The versatility of the stamping process will allow channel and track formation on either the faceplate or latch sled.

During the stamping process, an upwardly extending forked tongue 64 is stamped from the latch sled 50 to form a guide for the spring 90. The upwardly extending forked tongue 64 has a groove 66 wherein the spring 90 is guided during movement. As the upwardly extending forked tongue 64 is stamped from the latch sled 50, an opening 65 is produced. The opening 65 is notched at 62 to provide for secure mounting of the spring 90 to the latch sled 50. The notch 62 prevents the spring 90 from sliding longitudinally off of the end of the latch sled 50. A notch 60 is also provided on one end of the latch sled for additionally securing the spring 90. The notch 60 in conjunction with the notch 62 and the groove 66 prevent the spring from moving laterally off of the latch sled 50. The latch sled 50 is notched during the stamping process as shown at 54 and 58. This notch provides the necessary clearance from the pivot pin 38 to allow slidable movement of the latch sled 50 between engaged and disengaged positions. Additionally during the stamping process, a slot 69 is formed in the center of the latch sled 50. During the stamping of the slot 69, the material from the slot is formed into an actuator arm housing 68. The actuator arm housing 68 is slotted at 70 and 72 to provide additional guiding for the spring 90.

Means for slidably moving the latch sled 50 between engaged and disengaged positions is provided by an actuator arm 30. The actuator arm has a tail 34 and a head 32 with a mounting hole 36 being provided in the central portion of the actuator arm 30. The pivot pin 38 passes through the actuator arm mounting hole 36 and through corresponding mounting holes in the faceplate 10. The actuator arm head 32 has an end surface 31 and two sides surfaces 33 and 35. The side surface 33 contacts the upper housing surface 78 as the actuator arm tail 30 is moved downward thereby moving the sled with its attached bolt 100 into the engaged position. In the engaged position, the bolt 100 is moved into the latch bolt catch hole 9 which is located in the door frame 7. When the flush bolt of the present invention is to be disengaged, the tail of the actuator arm 34 is moved upward which causes the side surface 35 of the actuator arm head 32 to contact the lower housing surface 80 thereby moving the sled into the disengaged position.

Means for biasing the actuator arm 30 into the engaged or disengaged position is provided by the spring 90. When the actuator arm is in a position halfway between engagement and disengagement, the spring 90 is contacting the relatively flat actuator arm head end surface 31. In this position, the force of the spring is exerted perpendicularly against the pivot pin 38. In this position, the spring does not bias the actuator arm 30 to either the engaged or disengaged position. However, once the actuator arm tail 34 is moved on either side of the halfway position, the spring 90 biases the actuator arm toward the position of engagement or disengagement to which the actuator arm tail 34 is closest. Any type of conventional spring biasing could be used for this purpose, however, in the present invention, it is preferred that a rod of spring steel be utilized which has a mounting arc 92 and mounting bend 94 for attaching it to the latch sled 50. The mounting arc 92 is displaced within the notch 60 on the latch sled to prevent lateral movement of the spring 90 on the latch sled. The mounting bend 94 on the spring 90 is displaced in the notch 62 which is formed as a result of the stamping of the upwardly extending forked tongue member 64. The mounting bend 94 prevents longitudinal movement of the spring 90 off of the latch sled 50.

Additional guiding support for the spring 90 during its up-and-down movement relative to the faceplate 10 is provided by the grooves 72 and 70 in the actuator arm housing and the groove 66 in the upwardly extending forked tongue 64.

Figure 5:
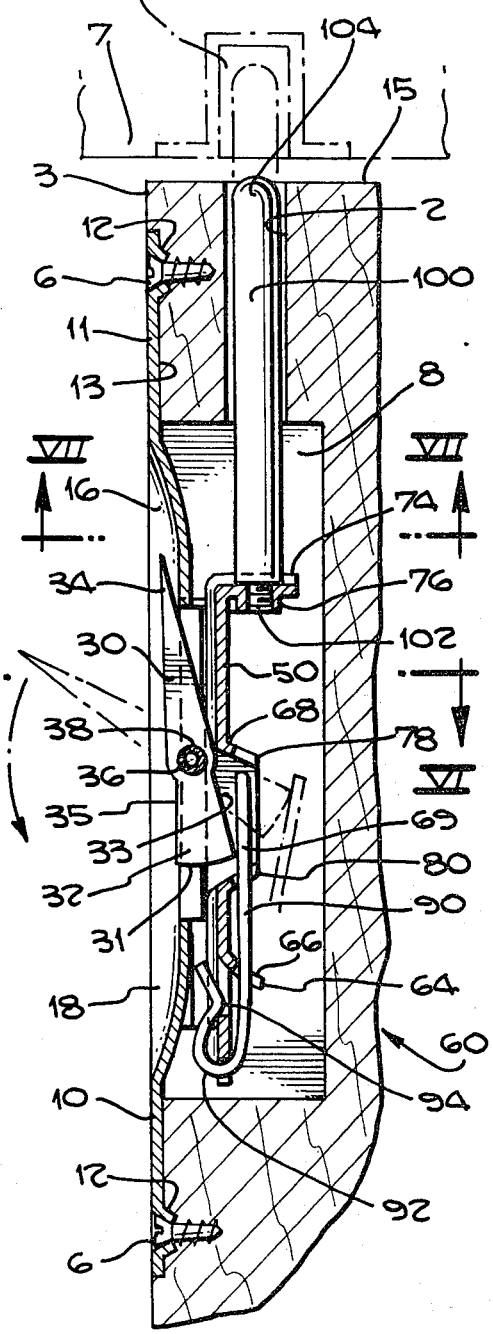
FIG. 5 is a cross-sectional view of FIG. 4 taken in the V—V plane.
Figure 6:
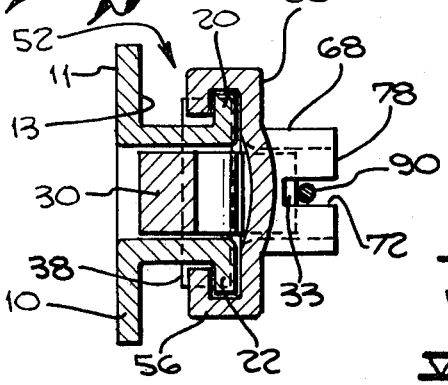
FIG. 6 is a cross-sectional view of FIG. 5 taken in the VI—VI plane.
Figure 7:
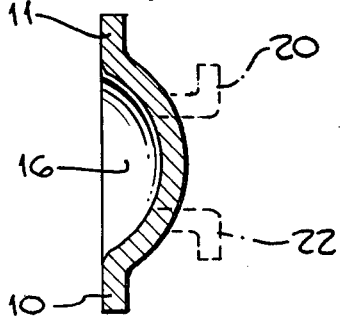
FIG. 7 is also a cross-sectional view of FIG. 5 which is taken in the VII—VII plane.
Figure 2:
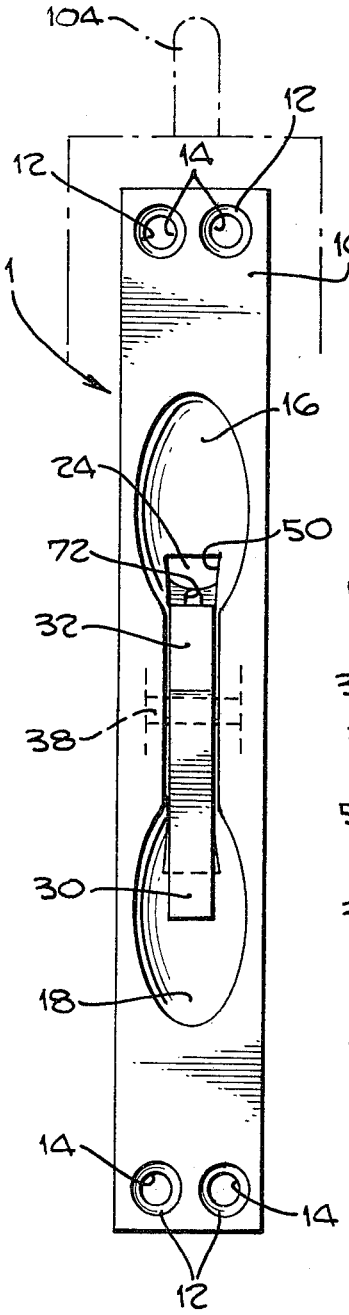
FIG. 2 is a planar view of the exterior surface of the flush bolt of the present invention.
Figure 3:
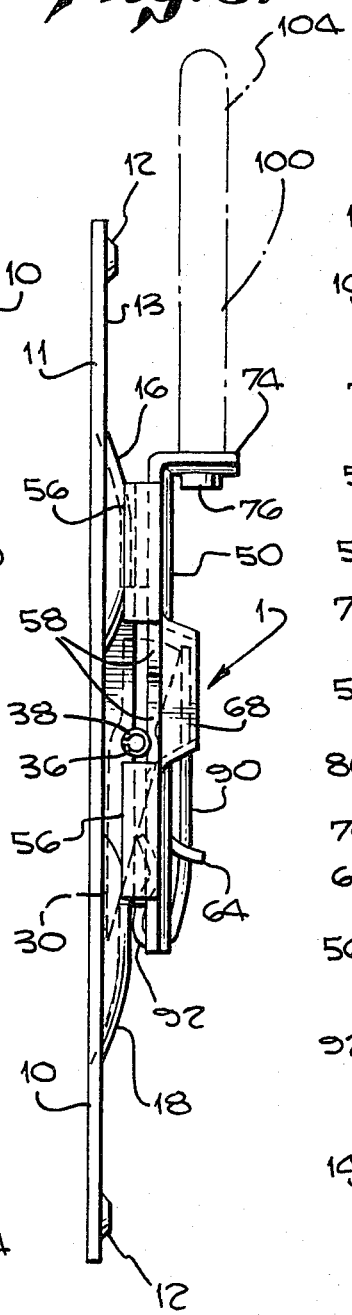
FIG. 3 is a side view of the flush bolt of the present invention.
Figure 4:
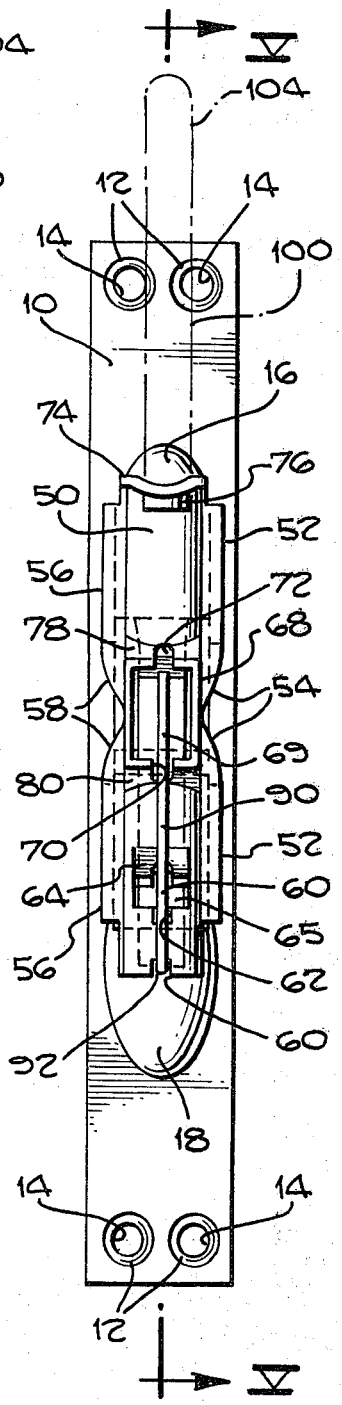
FIG. 4 is a planar view of the interior portion of the flush bolt of the present invention.

The bolt 100 can be made from any strong metal material. It is preferred that the bolt 100 be a metal rod having a blocking end 104 which can be inserted into the bolt catch hole 9 with a threaded stud 102 on the other end for attaching the bolt to the bolt mounting flange 74, as shown in FIG. 5.

In the preferred use of the present invention, the flush bolt 1 is mounted flush within the door. This is accomplished by forming a chamber 8 within the door to accommodate the door latch 1. Additionally, a hole 2 is bored from the door latch chamber 8 extending longitudinally to the upper edge of the door 15 so that the bolt 100 may be extended out from the door to engage the bolt catch hole 9. When the flush bolt 1 is intended to be in the disengaged position, the bolt 100 is retracted within the hole 2 so that it no longer contacts the bolt catch hole 9.

The present invention allows for the production of flush bolts more economically while still providing a flush bolt which is well suited for its intended purpose. This economy is accomplished by the ease, convenience and mass production capabilities of stamping processes coupled with virtually complete utilization of sheet metal material by the novel structures formed when material stamped from slots and holes is used to form integral structures on the face plates and latch sleds. While it is preferred that the disclosed novel structure be made by stamping, it can be manufactured by other methods as well. Having thus described the preferred exemplary embodiment of the present invention, it should be noted by those skilled in the art that the within disclosures are exemplary only and that various other alternatives, adaptations and modifications may be made within the scope of the present invention which is defined and limited only by the following claims.

We claim:

1. A flush bolt adapted for flush mounting on a door and operation between an engaged position with a securing surface and a disengaged position which comprises:

a faceplate;

a latch sled;

means for mounting said faceplate on said door;

integral tracks positioned longitudinally along said faceplate and extending upwardly and outwardly from said face plate for slidably engaging longitudinally positioned channels integrally associated with said latch sled wherein said channels extend downwardly and inwardly to accomplish said slidable engagement with said tracks;

means for slidably moving said latch sled to the engaged or disengaged position; and means for biasing said moving means to the engaged or disengaged position.

2. The flush bolt of claim 1 wherein said faceplate has a centrally located opening for receiving said moving means, wherein the material of said faceplate displaced during formation of said opening is used to integrally form said tracks.

3. The flush bolt of claim 1 wherein said latch sled is provided with an integral upwardly extending forked tongue member having a slot for guiding said biasing means.

4. A method for making a flush bolt adapted for flushing mounting on a door and operation between an engaged position with a securing surface and a disengaged position which comprises the steps of:

forming a faceplate;

forming a latch sled;

providing means for mounting said faceplate on said door;

forming integral tracks positioned longitudinally along said faceplate and extending upwardly and outwardly from said face plate for slidably engaging longitudinally positioned channels integrally associated with said latch sled;

forming said channels extending downwardly and inwardly from said latch sled to accomplish said slidable engagement with said tracks;

providing means for slidably moving said latch sled to the engaged or disengaged position; and providing means for biasing said moving means to the engaged or disengaged position.

5. The method of claim 4 which includes the step of forming a centrally located opening in said face plate for receiving said moving means, wherein the material of said faceplate displaced during formation of said opening is used to integrally form said tracks.

6. The method of claim 4 which includes the step of forming an integral upwardly extending forked tongue member having a slot for guiding said biasing means on said latch sled.

7. A bolt mechanism adapted for operation between an engaged position and a disengaged position which comprises:

a plate which is constructed by stamping sheet metal;

a latch sled which is constructed by stamping sheet metal;

means for slidably mounting said latch sled on said plate comprising longitudinal tracks that are formed as an integral part of said plate by stamping and which slidably engage longitudinal channels formed as an integral part of said latch sled by stamping;

means for slidably moving said latch sled between engaged and disengaged positions; and means for biasing said moving means to the engaged or disengaged position.

8. The bolt mechanism of claim 7 wherein said latch sled is provided with an integral upwardly extending forked tongue member having a slot for guiding said biasing means.

9. The bolt mechanism of claim 8 wherein said forked tongue member is formed integral with the latch sled by stamping.

10. The bolt mechanism of claim 8 wherein the formation of said upwardly extending forked tongue member produces a slot on said latch sled, said slot including at least one notch being used for securing said biasing means to said latch sled.

11. A method for making a bolt mechanism adapted for operation between an engaged position and a disengaged position which comprises the steps of:

forming a plate by stamping sheet metal;

forming a latch sled by stamping sheet metal;

providing means for slidably mounting said latch sled on said plate by forming longitudinal tracks as an integral part of said plate by stamping and by forming longitudinal channels as an integral part of said latch sled by stamping so that the longitudinal tracks and the longitudinal channels slidably engage each other;

providing means for slidably moving said latch sled between engaged and disengaged positions; and providing means for biasing said moving means to the engaged or disengaged positions.

12. The method of claim 11 wherein said plate and latch sled are constructed from sheet metal having a thickness between 0.04 inches and 0.10 inches.

13. The method of claim 11 which includes the step of integrally forming an upwardly extending forked tongue member on said latch sled and having a slot for guiding said biasing means.

14. The method of claim 13 wherein the formation of said tongue member is accomplished by stamping sheet metal.

15. The method of claim 13 which includes the step of forming a housing having upwardly extending walls surrounding an opening on said latch sled, said upwardly extending walls being formed integrally with the latch sled material displaced to form said opening.

16. A flush bolt adapted for flush mounting on a door and operation between an engaged position with a securing surface and a disengaged position which comprises:

a faceplate which is constructed by stamping sheet metal;

a latch sled constructed by stamping sheet metal;

means for mounting said faceplate on said door;

means for slidably mounting said latch sled on said faceplate, wherein said slidable mounting means comprises longitudinal tracks that are formed as an integral part of said faceplate by stamping, which slidably engage longitudinal channels formed as an integral part of said latch sled by stamping;

means for slidably moving said latch sled between engaged and disengaged positions; and means for biasing said moving means to the engaged or disengaged position.

17. A flush bolt adapted for flush mounting on a door and operation between an engaged position with a securing surface and a disengaged position which comprises:

a faceplate which is constructed by stamping sheet metal;

a latch sled wherein said latch sled is provided with an integral upwardly extending forked tongue member having a slot for guiding said biasing means;

means for mounting said faceplate on said door;

means for slidably mounting said latch sled on said faceplate;

means for slidably moving said latch sled between engaged and disengaged positions;

means for biasing said moving means to the engaged or disengaged position; and wherein the formation of said upwardly extending forked tongue member produces a slot on said latch sled, said slot including at least one notch being used for securing said biasing means to said latch sled.

18. A method for making a flush bolt adapted for flush mounting on a door and operation between an engaged position with a securing surface and a disengaged position which comprises the steps of:

forming a faceplate by stamping sheet metal;

forming a latch sled by stamping sheet metal;

providing means for mounting said faceplate on said door;

providing means for slidably mounting said latch sled on said faceplate;

providing means for slidably moving said latch sled between engaged and disengaged positions;

providing means for biasing said moving means to the engaged or disengaged position; and wherein said slidable mounting means are provided by forming longitudinal tracks as an integral part of said faceplate by stamping, which slidably engaged longitudinal channels which are formed as an integral part of said latch sled by stamping.

* * * * *